US011421576B2

(12) United States Patent
Bluemelhuber et al.

(10) Patent No.: US 11,421,576 B2
(45) Date of Patent: Aug. 23, 2022

(54) EXHAUST GAS SYSTEM FOR AN INTERNAL COMBUSTION ENGINE

(71) Applicant: Bayerische Motoren Werke Aktiengesellschaft, Munich (DE)

(72) Inventors: Uli Bluemelhuber, Munich (DE); Carina Hoefler, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 288 days.

(21) Appl. No.: 16/658,352

(22) Filed: Oct. 21, 2019

(65) Prior Publication Data

US 2020/0049055 A1 Feb. 13, 2020

Related U.S. Application Data

(63) Continuation of application No. PCT/EP2018/064811, filed on Jun. 6, 2018.

(30) Foreign Application Priority Data

Jul. 19, 2017 (DE) ..... 10 2017 212 307.9

(51) Int. Cl.
*F01N 13/00* (2010.01)
*F01N 1/02* (2006.01)
*F01N 11/00* (2006.01)

(52) U.S. Cl.
CPC ..... *F01N 13/008* (2013.01); *F01N 1/02* (2013.01); *F01N 11/007* (2013.01); (Continued)

(58) Field of Classification Search
CPC ..... F01N 2610/148; F01N 13/08; F01N 2560/025; F01N 2590/04; F01N 13/008
See application file for complete search history.

(56) References Cited

U.S. PATENT DOCUMENTS 4,183,212 A * 1/1980 Takagi ..... F01N 3/22 60/274
2009/0019833 A1* 1/2009 Yonushonis ..... G01K 1/022 60/277

(Continued)

FOREIGN PATENT DOCUMENTS

CN 1424222 A 6/2003
CN 103201484 A 7/2013

(Continued)

OTHER PUBLICATIONS

English Translation H09125935A (Year: 1997).*

(Continued)

*Primary Examiner* — Anthony Ayala Delgado
(74) *Attorney, Agent, or Firm* — Crowell & Moring LLP

(57) ABSTRACT

An exhaust gas system for an internal combustion engine of a single-track vehicle can be arranged on an exhaust gas outlet of a cylinder head. A first lambda probe close to the cylinder head is provided in the exhaust gas system and is arranged before an exhaust gas cleaning system in the flow direction of an exhaust gas. A second lambda probe is provided in the exhaust gas system after the exhaust gas cleaning system in the flow direction of the exhaust gas. The second lambda probe is arranged at a maximum distance away from the exhaust gas cleaning system equal to four times the diameter of the exhaust gas cleaning system. As a result of the design, the lambda probe is arranged in the non-visible region of the single-track vehicle, while simultaneously examining the quality of the exhaust gas cleaning.

4 Claims, 1 Drawing Sheet

(52) U.S. Cl.
CPC .... *F01N 2560/025* (2013.01); *F01N 2560/14* (2013.01); *F01N 2590/04* (2013.01)

(56) References Cited

U.S. PATENT DOCUMENTS

| | | | | |
|---|---|---|---|---|
| 2013/0297192 | A1 | 11/2013 | Imeroski | |
| 2014/0370606 | A1 | 12/2014 | Odendall | |
| 2016/0245147 | A1 * | 8/2016 | Hayama | F01N 13/107 |
| 2017/0350335 | A1 * | 12/2017 | Muramatsu | F02D 41/1441 |
| 2017/0363023 | A1 | 12/2017 | Arima et al. | |

FOREIGN PATENT DOCUMENTS

| | | | |
|---|---|---|---|
| CN | 105612325 | A | 5/2016 |
| DE | 38 21 345 | A1 | 6/1989 |
| DE | 195 41 903 | A1 | 5/1997 |
| DE | 297 08 768 | U1 | 10/1998 |
| DE | 10 2010 050 055 | A1 | 5/2012 |
| DE | 10 2011 121 099 | A1 | 6/2013 |
| DE | 10 2015 220 254 | A1 | 4/2017 |
| EP | 3 064 722 | A1 | 9/2016 |
| EP | 3 276 149 | A1 | 1/2018 |
| JP | 09125935 | A * | 5/1997 |
| JP | 2003-206784 | A | 7/2003 |
| JP | 2015-58921 | A | 3/2015 |
| JP | 2016-160915 | A | 9/2016 |
| JP | 2016-183652 | A | 10/2016 |
| JP | 2017-110616 | A | 6/2017 |
| WO | WO 2015/065931 | A1 | 5/2015 |

OTHER PUBLICATIONS

Chinese-language Office Action issued in Chinese Application No. 201880028723.9 dated Dec. 16, 2020 with English translation (ten (10) pages).

International Search Report (PCT/ISA/210) issued in PCT Application No. PCT/EP2018/064811 dated Jul. 30, 2018 with English translation (five (5) pages).

German-language Written Opinion (PCT/ISA/237) issued in PCT Application No. PCT/EP2018/064811 dated Jul. 30, 2018 (five (5) pages).

German-language Search Report issued in counterpart German Application No. 10 2017 212 307.9 dated Apr. 10, 2018 with partial English translation (14 pages).

Chinese Office Action issued in Chinese application No. 201880028723.9 dated Dec. 14, 2021, with English translation (Eleven (11) pages).

* cited by examiner

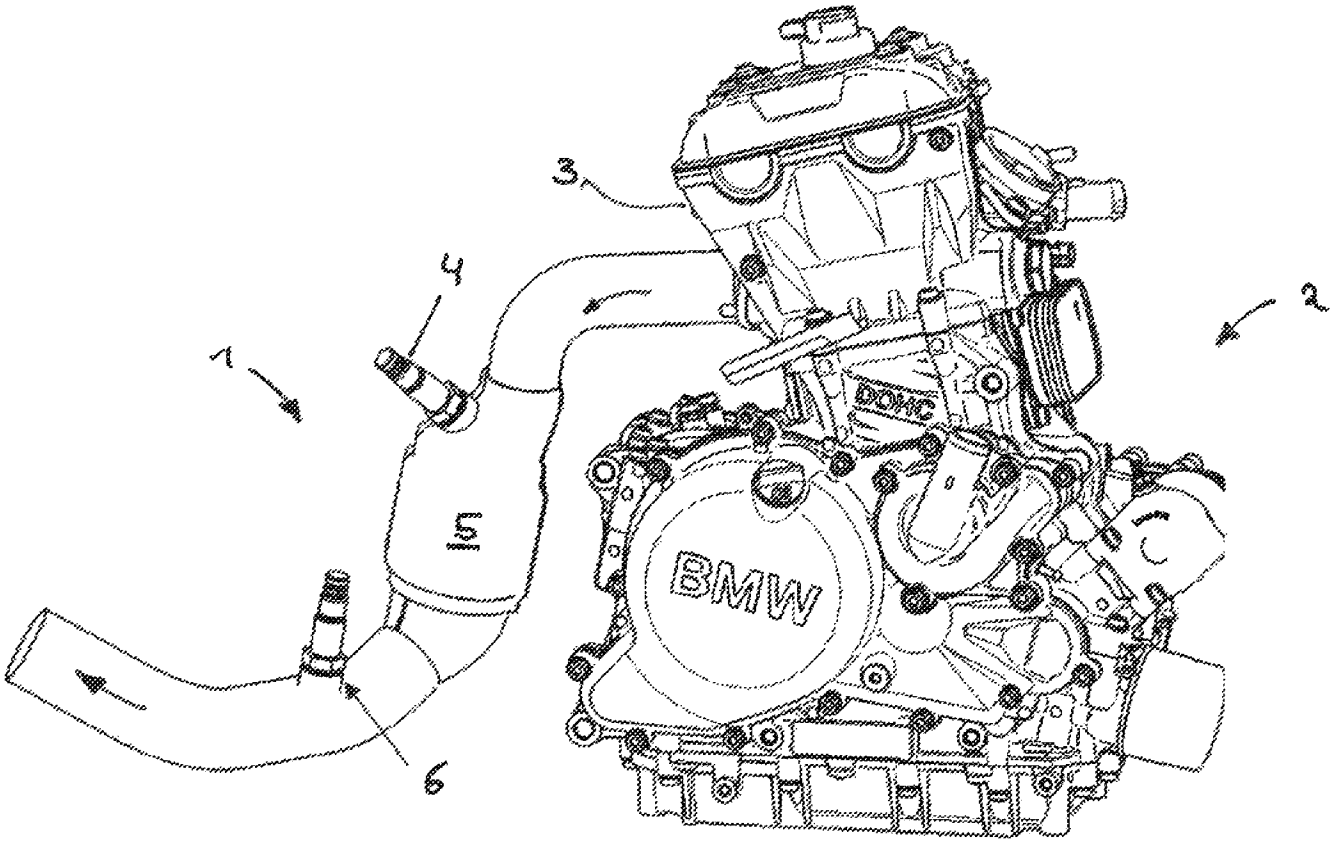
2
3
4
5
6
7
BMW
DOHC

EXHAUST GAS SYSTEM FOR AN INTERNAL COMBUSTION ENGINE

CROSS REFERENCE TO RELATED APPLICATIONS

This application is a continuation of PCT International Application No. PCT/EP2018/064811, filed Jun. 6, 2018, which claims priority under 35 U.S.C. § 119 from German Patent Application No. 10 2017 212 307.9, filed Jul. 19, 2017, the entire disclosures of which are herein expressly incorporated by reference.

BACKGROUND AND SUMMARY OF THE INVENTION

The invention relates to an exhaust-gas system for an internal combustion engine of a single-track vehicle.

A device for reducing pollution components in the exhaust gas of an internal combustion engine is known from the field of automotive engineering, for example from the German laid-open application DE 3 821 345 A1. The internal combustion engine has, in its exhaust tract, a catalytic converter and two oxygen probes (lambda probes). The first probe is arranged upstream of the catalytic converter, and the second is arranged in the catalytic converter. The arrangement of these two probes permits a high closed-loop control frequency, taking into consideration the catalytic converter state and ruling out hydrogen cross-sensitivity. In the catalytic converter positioned downstream of the second probe, the still incompletely converted exhaust gases detected by said probe are converted completely.

For the diagnosis of an exhaust-gas catalytic converter and/or of an exhaust-gas sensor of a motor vehicle internal combustion engine, a method for this is known from the German laid-open application DE 10 2010 050 055 A1. For this, the exhaust-gas system has two oxygen sensors upstream of the catalytic converter and one further oxygen sensor downstream of the catalytic converter, the signals of which oxygen sensors are evaluated by a control unit.

With regard to the further technical field, reference is made to the German laid-open application DE 195 41 903 A1. This laid-open application discloses a monitoring system for the purification of exhaust gases of an internal combustion engine for a motor vehicle, wherein two lambda probes are provided, one of which is arranged upstream and the other, heatable one of which is arranged downstream of the catalytic converter. Proceeding from a cold start of the internal combustion engine substantially until the catalytic converter light-off temperature is attained, the downstream probe is not heated but rather is used for determining the exhaust-gas temperature, wherein the attainment of a minimum temperature within a certain time period is checked.

These known exhaust-gas purification devices are however provided exclusively for motor vehicles, and cannot be readily transferred to a single-track vehicle such as for example a motorcycle, a moped, a moped with kick starter, or a motor-assisted bicycle.

To ensure low-omission operation of a motorcycle with an internal combustion engine, it is necessary for the exhaust gas that is produced by the internal combustion engine to be purified by way of an exhaust-gas purification system, such as for example a catalytic converter. To make this efficient, particular values of the exhaust gas are therefore measured, upstream of the catalytic converter, by use of a so-called lambda probe (oxygen probe). Here, however, no validation of the quality of the exhaust-gas purification is performed.

Furthermore, this prior art which is known for single-track vehicles falls far short of being sufficient for future exhaust-gas standards, such as for example the EU 5 standard for single-track vehicles.

It has disadvantageously been the case until now that no validation of the quality of the exhaust-gas purification for single-track vehicles has been known or possible. These therefore also do not satisfy future exhaust-gas standards such as for example the EU 5 standard.

It is an object of the present invention to provide a measure for avoiding the above-stated disadvantages for single-track vehicles.

This and other objects are achieved by an exhaust-gas system for an internal combustion engine of a single-track vehicle, wherein the exhaust-gas system is arrangeable at an exhaust-gas outlet of a cylinder head of the internal combustion engine, and wherein a first lambda probe situated close to the cylinder head is provided in the exhaust-gas system. The first lambda probe is arranged upstream of an exhaust-gas purification system in relation to a flow direction of an exhaust gas. A second lambda probe is provided in the exhaust-gas system downstream of the exhaust gas purification system in relation to the flow direction of the exhaust gas. The second lambda probe is arranged in the exhaust-gas system so as to be at a distance from the exhaust gas purification system of at most four times the diameter of the exhaust-gas purification system.

It is an aim of the invention to further reduce the harmful emissions of internal combustion engines for single-track vehicles, such as for example motorcycles. Here, according to the invention, the quality of the exhaust gas purification is checked during operation. This is realized by an ideal positioning of two lambda probes in the exhaust-gas stream of the internal combustion engine.

The flow patterns of the exhaust gas that emerges directly from the internal combustion engine are, inter alia owing to the geometry of the exhaust-gas system, relatively complex, and exhibit greater inhomogeneity with increasing flow length. Here, it is advantageous for the first lambda probe to be positioned as close as possible to the outlet of the internal combustion engine (close to the cylinder head). This spacing should correspond at most to ten times the diameter of the outlet opening in the cylinder head of the internal combustion engine.

According to the invention, for the checking of the quality of the exhaust-gas purification, the second lambda probe, also referred to as a monitor probe, is positioned downstream of the catalytic converter, which second lambda probe measures the purified exhaust gas stream. Here, according to the invention, the spacing between the second lambda probe and the catalytic converter should correspond at most to four times the catalytic converter diameter.

This permits considerably improved structural space utilization within the non-visible region of the single-track vehicle. In particular, it is the intention for the system to be used even in exhaust-gas which uses a muffler, in particular a premuffler. Here, the premuffler may be positioned between the internal combustion engine and its swinging fork. This applies in particular to downpipes and exhaust-gas system components that are flowed through vertically, such as for example catalytic converters and mufflers between the rear wheel and swinging fork of the single-track vehicle.

The embodiment according to the invention leads to an improved exhaust-gas measurement and therefore to more environmentally compatible operation of the single-track vehicle. Furthermore, it is advantageously the case that future exhaust-gas standards are satisfied, with simultaneous utilization of existing structural space in the non-visible region of the single-track vehicle. This leads to considerably improved packaging compatibility.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 shows a view of an internal combustion engine with an exemplary exhaust-gas system according to the invention.

DETAILED DESCRIPTION OF THE DRAWING

FIG. 1 shows a view of an internal combustion engine 2 with an exhaust-gas system 1 for a single-track vehicle, such as for example a motorcycle, a moped, a moped with kick starter or a motor-assisted bicycle.

The internal combustion engine 2 has a cylinder head 3, at the exhaust-gas outlet (not designated) of which an exhaust-gas system 1 is arranged. The exhaust-gas system 1 is composed substantially of an exhaust-gas pipe (not designated), in which a first lambda probe 4 (oxygen probe) is arranged close to the cylinder head. The first lambda probe 4 is situated between the cylinder head 3 and an exhaust-gas purification system 5. The exhaust-gas purification system 5, such as for example a three-way catalytic converter, is encased in the present exemplary embodiment by an additional sheet-metal paneling (not designated) as a heat shield. A flow direction of the exhaust gas is indicated by two arrows.

A second lambda probe 6 (oxygen probe) is arranged in the exhaust-gas system 1 downstream of the exhaust-gas purification device 5 in relation to the flow direction of the exhaust gas. According to the invention, the second lambda probe 6 is arranged in the exhaust-gas system 1 at a distance from the exhaust-gas purification system 5 of at most four times the diameter of the exhaust-gas purification system 5. The diameter of the exhaust-gas purification system 5 is the diameter of the catalytically coated monolith without its encasement. The diameter applies to the cross section of circular exhaust-gas purification systems 5. In the case of exhaust-gas purification systems 5 of oval cross section, the spacing of four times the greatest diameter of the catalytically coated monolith applies.

In one refinement of the invention, a muffler (not illustrated in the present exemplary embodiment) is arranged between the cylinder head 3 and the first lambda probe 4. This muffler is preferably a premuffler.

The positioning of the first lambda probe 4 close to the cylinder head means that the first lambda probe 4 is arranged in the exhaust-gas system 1 at a distance from the cylinder head 3 of at most ten times the diameter of the exhaust-gas outlet in the cylinder head 3.

In a further refinement of the invention, the muffler is arranged between the internal combustion engine and a swinging fork of a single-track vehicle (not illustrated).

The embodiment according to the invention of the exhaust-gas system 1 leads to an improved exhaust-gas measurement and thus to considerably more environmentally compatible operation of the internal combustion engine 2. It is furthermore possible for future exhaust-gas standards, such as for example Euro 5, to be satisfied for single-track vehicles. What is particularly advantageous is the utilization of existing structural space in the non-visible region, with the best possible packaging compatibility.

LIST OF REFERENCE DESIGNATIONS

1 Exhaust-gas system
2 Internal combustion engine
3 Cylinder head
4 First lambda probe
5 Exhaust-gas purification system
6 Second lambda probe The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust-gas system for an internal combustion engine of a single-track vehicle, wherein the exhaust-gas system is arrangeable at an exhaust-gas outlet of a cylinder head of the internal combustion engine, comprising:

a first lambda probe situated close to the cylinder head in the exhaust-gas system, which first lambda probe is arranged upstream of an exhaust-gas purification system in relation to a flow direction of an exhaust gas; and a second lambda probe provided in the exhaust-gas system downstream of the exhaust gas purification system in relation to the flow direction of the exhaust gas, wherein the first lambda probe is arranged in the exhaust-gas system at a distance from the cylinder head of at most ten times the diameter of the exhaust-gas outlet, the second lambda probe is arranged in the exhaust-gas system so as to be at a distance from the exhaust gas purification system of at most four times a diameter of the exhaust-gas purification system.

2. The exhaust-gas system according to claim 1, further comprising:

a muffler arranged between the cylinder head and the first lambda probe.

3. The exhaust-gas system according to claim 2, wherein the muffler is a premuffler.

4. A single-track vehicle, comprising:

an internal combustion engine having a cylinder head with an exhaust gas outlet; and an exhaust gas system arranged at the exhaust-gas outlet of the cylinder head of the internal combustion engine, the exhaust gas system comprising:

a first lambda probe situated close to the cylinder head in the exhaust-gas system, which first lambda probe is arranged upstream of an exhaust-gas purification system in relation to a flow direction of exhaust gas;

a second lambda probe provided in the exhaust-gas system downstream of the exhaust gas purification system in relation to the flow direction of the exhaust gas, wherein the first lambda probe is arranged in the exhaust-gas system at a distance from the cylinder head of at most ten times the diameter of the exhaust-gas outlet, the second lambda probe is arranged in the exhaust-gas system so as to be at a distance from the exhaust gas purification system of at most four times a diameter of the exhaust-gas purification system; and a muffler arranged between the internal combustion engine and a swinging fork of the single-track vehicle.

* * * * *